US010699890B2

(12) United States Patent
Schwieters et al.

(10) Patent No.: US 10,699,890 B2
(45) **Date of Patent: *Jun. 30, 2020**

(54) DETERMINATION OF ISOBARIC INTERFERENCES IN A MASS SPECTROMETER

(71) Applicant: Thermo Fisher Scientific (Bremen) GmbH, Bremen (DE)

(72) Inventors: Johannes Schwieters, Genderkesee (DE); Henning Wehrs, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/292,815

(22) Filed: Mar. 5, 2019

(65) Prior Publication Data

US 2019/0221416 A1 Jul. 18, 2019

Related U.S. Application Data

(63) Continuation of application No. 15/846,090, filed on Dec. 18, 2017, now Pat. No. 10,290,486.

(30) Foreign Application Priority Data

Dec. 19, 2016 (GB) ..... 1621568.3

(51) Int. Cl.
*H01J 49/10* (2006.01)
*H01J 49/00* (2006.01)

(52) U.S. Cl.
CPC ..... *H01J 49/105* (2013.01); *H01J 49/0027* (2013.01)

(58) Field of Classification Search
CPC ..... H01J 49/26; H01J 49/105
(Continued)

(56) References Cited

U.S. PATENT DOCUMENTS 5,049,739 A 9/1991 Okamoto
10,290,486 B2 * 5/2019 Schwieters ..... H01J 49/0027
(Continued)

FOREIGN PATENT DOCUMENTS

EP 08/13228 B1 7/2002
WO 97/25737 A1 7/1997
WO 03/009332 A1 1/2003

OTHER PUBLICATIONS

Bandura et al., "Gas-phase ion-molecule reactions for resolution of atomic isobars: AMS and ICP-MS perspectives", International Journal of Mass Spectrometry, vol. 255-256 (2006), pp. 312-327.
(Continued)

*Primary Examiner* — Nicole M Ippolito
(74) *Attorney, Agent, or Firm* — David A. Schell

(57) ABSTRACT

Methods of determining isobaric interference during mass analysis in a mass spectrometer are provided. The methods comprise comparing interference-free reaction profiles of a chemical species to reaction profiles of the same chemical species that may comprise isobaric interference, wherein a determination of a difference between the profiles is an indication of isobaric interference being present. Methods of quantifying isobaric interference are also provided, including methods of correcting isotope ratios determined in the presence of isobaric interference.

9 Claims, 13 Drawing Sheets

(58) Field of Classification Search
USPC ..... 250/281, 282, 283, 288
See application file for complete search history.

(56) References Cited

U.S. PATENT DOCUMENTS

| | | | | |
|---|---|---|---|---|
| 2015/0318159 | A1 | 11/2015 | Badiei et al. | |
| 2017/0140914 | A1 | 5/2017 | Wehrs | |
| 2017/0205425 | A1 | 7/2017 | Yip et al. | |
| 2018/0102243 | A1 | 4/2018 | Stephenson, Jr. et al. | |
| 2018/0174814 | A1* | 6/2018 | Schwieters ..... | H01J 49/0027 |

OTHER PUBLICATIONS

Hattendorf et al., "Suppression of in-cell generated interferences in a reaction cell ICP-MS by bandpass tuning and kinetic energy discrimination," J. Anal. At. Spectrom., 2004, 19, pp. 600-606.
Holland et al., "Reaction Cells and High Resolution. Determination of 44CA-Isotope Markers for Parasitoid Studies Using Dynamic Reaction Cell ICPMS", Special Publication, Royal Society of Chemistry, 2005, vol. 301, pp. 91-98.
Koppenaal et al., "Collision arid reaction cells in atomic mass spectrometry: development, status, and applications," J. Anal. At. Spectrom., 19, 561-570, 2004.
Tanner et al., "Reaction cells and collision cells for ICP-MS: a tutorial review", Spectrochimica Acta Part B 57 (2002), 1361-1452.
Weyer et al., "High precision Fe isotope measurements with high mass resolution MC-ICPMS," Int. J. Mass Spec., 226, 355-368, 2003.

* cited by examiner

DETERMINATION OF ISOBARIC INTERFERENCES IN A MASS SPECTROMETER

CROSS-REFERENCE TO RELATED APPLICATIONS

The present application is a continuation under 35 U.S.C. § 120 and claims the priority benefit of co-pending U.S. patent application Ser. No. 15/846,090, filed Dec. 18, 2017. The disclosure of the foregoing application is incorporated herein by reference.

STATEMENT RELATING TO FUNDING

The work leading to this invention has received funding from the European Research Council under the European Union's Seventh Framework Programme (FP7/2007-2013)/ERC grant agreement n° FP7-GA-2013-321209.

FIELD

The invention relates to the assessment of interferences in mass analysis, in particular mass analysis using an inductively coupled plasma mass spectrometer (ICP-MS).

INTRODUCTION

Mass spectrometry is an analytical method for qualitative and quantitative determination of molecular species present in samples, based on the mass to charge ratio and abundance of gaseous ions.

In inductively coupled plasma mass spectrometry (ICP-MS), atomic species can be detected with high sensitivity and precision, at concentrations as low as 1 in $10^{15}$ with respect to a non-interfering background. In ICP-MS, the sample to be analyzed is ionized with an inductively coupled plasma and subsequently separated and quantified in a mass analyzer.

Precise and accurate isotope ratio measurements very often provide the only way to gain deeper insight into scientific questions which cannot be answered by any other analytical technique. Multicollector ICP-MS is an established method for high precision and accurate isotope ratio analysis. Applications of ICP-MS are in the field of geochronology, geochemistry, cosmochemistry, biogeochemistry, environmental sciences as well as in life sciences. However, elemental and molecular interferences in the mass spectrometer can limit the attainable precision and accuracy of the analysis.

These interferences, which occur on the same nominal mass as that of the atomic or molecular species of interest (also called isobaric interferences), can be present in the sample material itself or are generated by sample preparation from a contamination source, such as chemicals used, sample containers, or by fractionation during sample purification. Contaminating species can also be generated in the ion source or in the mass spectrometer.

In order to achieve high precision and accurate isotope ratio measurements, extended physical and chemical sample preparation is applied to get clean samples free from possible interferences and contamination that can interfere in the mass spectrum. Typical concentrations of analyte in sample material used in isotope ratio ICP-MS are in the range of parts per billion. The analyte of interest may also be concentrated in small inclusions or crystals within a heterogeneous sample material, for example in rock samples.

Extended quality control steps are integrated into the sample preparation to ensure that the sample preparation itself does not lead to changes in the isotope ratio of the sample material. Every sample preparation step comes along with the possibility of adding contamination to the samples and/or causing isotopic fractionation of the analyte to be extracted from the original sample material, which could be for instance a rock, a crystal, soil, a dust particle, a liquid and/or organic matter. Even if all these steps are taken with great care there still is the chance of contamination and incomplete separation and interferences in the mass spectrum.

Ideally one would like to completely avoid the chemical sample preparation step. Moreover a chemical sample preparation is impossible if a laser is used to directly ablate the sample and flush the ablated material into the ICP source. In such cases, there is no chemical separation of the desired analyte from the sample matrix and all the specificity has to come from the mass analyzer and the sample introduction system in the mass analyzer. Specificity describes the ability of an analyzer to unambiguously determine and identify a certain species in a sample. One way to achieve specificity in a mass spectrometer is to ensure that the mass resolving power $M/(\Delta M)$ of the mass analyzer is large enough to clearly separate one species from another species where $\Delta M$ is meant to be the mass difference of both species and M is the mass of the species of interest. This requires very high mass resolution in case of isobaric interferences of species with the same nominal mass. For sector field mass spectrometers high mass resolution comes along with using very narrow entrance slits to the mass analyzer and the small entrance slits significantly reduce the transmission and thus the sensitivity of the mass analyzer. As a consequence, this becomes an unpractical approach where very high mass resolving power is required. This is a special challenge for mass spectrometry instrumentation where current technical solutions are limited.

The Inductively Coupled Plasma (ICP) ion source is a very efficient ion source for elemental and isotopic analysis using mass spectrometry. This is an analytical method that is capable of detecting elements at very low concentration, as low as one part in $10^{15}$ (part per quadrillion, ppq) on non-interfered low-background isotopes. The method involves ionizing the sample to be analyzed with an inductively coupled plasma and then using a mass spectrometer to separate and quantify the thus generated ions.

Ionizing a gas, usually argon, in an electromagnetic coil, to generate a highly energized mixture of argon atoms, free electrons and argon ions, generates the plasma, in which the temperature is high enough to cause atomization and ionization of the sample. The ions produced are introduced, via one or more stages of pressure reduction, into a mass analyzer which is most commonly a quadrupole analyzer, a magnetic sector analyzer or a time-of-flight analyzer, or an orbital electrostatic trap analyzer (such as an ORBITRAP mass analyzer).

High precision mass analyzers allow for high mass resolution to separate elemental ions from molecular species which to some extent are inevitably formed inside the ICP source (e.g. $OH^+$, $NO^+$, $CO^+$, $CO_2^+$, $ArO^+$, $ArN^+$, $ArAr^+$, etc.) and interfere with elemental ions. Thus, certain elements are known to have relatively poor detection limits by ICP-MS. These are predominantly those that suffer from artefacts or spectral interferences generated by ions that are derived from the plasma gas, matrix components or the solvent used to solubilize samples. Examples include $^{40}Ar^{16}O$ for determination of $^{56}Fe$, $^{38}ArH$ for determination of $^{39}K$, $^{40}Ar$ for determination of $^{40}Ca$, $^{40}Ar^{40}Ar$ for determination of $^{80}Se$, $^{40}Ar^{35}Cl$ for determination of $^{75}As$, $^{40}Ar^{12}C$ for determination of $^{52}Cr$ and $^{35}Cl^{16}O$ for determination of $^{51}V$.

With a high mass resolution magnetic sector multicollector mass spectrometer the molecular species can be separated along the focal plane of the mass spectrometer so that just the elemental ions can be detected while the molecular interferences are discriminated at the detector slit (see Weyer & Schwieters, International Journal of Mass Spectrometry, Vol. 226, Number 3, May 2003, herein incorporated by reference). This procedure works well for interferences where the relative mass deviation between the analyte and the interference is in the range of $(M/\Delta M)<2{,}000\text{-}10{,}000$ (M: mass of the analyte, ΔM: mass difference between analyte and interference).

With a sector mass spectrometer high mass resolution usually comes along with reduced ion optical transmission into to the mass analyzer because high mass resolution requires narrower entrance slits and smaller apertures to minimize second or third order angular aberrations further down the ion beam path from the entrance slit to the detector. In the particular case where the amount of sample is limited or the analyte concentration in a sample is low the reduced sensitivity in high mass resolution mode is a significant problem. It directly results in reduced analytical precision because of poorer counting statistics at effectively reduced transmission through the sector field analyzer. Therefore high mass resolution is not generally a practical solution to eliminate interferences and to gain specificity even in cases where the mass resolving power of the mass spectrometer would be sufficient to discriminate the interferences.

There are other applications where isobaric interferences of elemental ions cannot be avoided by sample preparation and where mass resolving power>>10,000 would be required to separate the interfering species. One example is the analysis of $^{40}Ca$ with argon based plasma. There is a strong interference of elemental $^{40}Ar^+$ on $^{40}Ca^+$. The required mass resolution to separate both species would be >193,000 which is much greater than that which can be achieved by a magnetic sector field analyzer.

One solution to this problem is provided by collision cell technology (ICP-CCT) that includes a collision/reaction cell that is positioned before the analyzer. This collision cell adds another possibility to achieve specificity for the analysis. Instead of mass resolving power it uses chemical reactions to distinguish between interfering species. Into this cell, which typically comprises a multipole operating in a radiofrequency mode to focus the ions, a collision gas such as helium or hydrogen is introduced. The collision gas collides and reacts with the ions in the cell, to convert interfering ions to harmless non-interfering species.

A collision cell may be used to remove unwanted artefact ions from an elemental mass spectrum. The use of a collision cell is described, e.g., in EP 0813228 A1, WO 97/25737 and U.S. Pat. No. 5,049,739 B, all herein incorporated by reference. A collision cell is a substantially gas-tight enclosure through which ions are transmitted. It is positioned between the ion source and the main mass analyzer. A target gas (molecular and/or atomic) is admitted into the collision cell, with the objective of promoting collisions between ions and the neutral gas molecules or atoms. The collision cell may be a passive cell, as disclosed in U.S. Pat. No. 5,049,739 B, or the ions may be confined in the cell by means of ion optics, for example a multipole which is driven with alternating voltages or a combination of alternating and direct voltages, as in EP 0813228. By this means the collision cell can be configured so as to transmit ions with minimal losses, even when the cell is operated at a pressure that is high enough to guarantee many collisions between the ions and the gas molecules.

For example, the use of a collision cell where about 2% $H_2$ is added to He gas inside the cell selectively neutralizes $^{40}Ar^+$ ion by low energy collisions of the $^{40}Ar^+$ with the $H_2$ gas and a resonant charge transfer of an electron from the $H_2$ gas to neutralize the $^{40}Ar^+$ ions (see Tanner, Baranov & Bandura, 2002, Spectrochimica Acta Part B: Atomic Spectroscopy, 57:1361-1452, herein incorporated by reference). This charge transfer mechanism is very selective and efficiently neutralizes argon ions and thus discriminates $^{40}Ar^+$ ions from $^{40}Ca^+$. These types of effects are sometimes called chemical resolution (Tanner & Holland, 2001, in: Plasma Source Mass Spectrometry: The New Millennium, Publisher: Royal Soc of Chem) in comparison to mass resolution in the case of mass spectrometer.

In addition to the charge transfer reaction other mechanisms inside the collision cell using other collision gases or mixtures of collision gases may be applied to reduce interferences. These mechanisms include: kinetic energy discrimination due to collisions inside the collision cell (e.g., Hattendorf & Guenther, 2004, J. Anal Atom Spectroscopy 19:600), herein incorporated by reference), fragmentation of molecular species inside the collision cell (see Koppenaal, D., W., Eiden, G., C. and Barinaga, C., J., (2004), *Collision and reaction cells in atomic mass spectrometry: development, status, and applications*, Journal of Analytical Atomic Spectroscopy, Volume 19, p.: 561-570 herein incorporated by reference), and/or mass shift reactions inside the collision cell. This toolbox of ICP-CCT can come closer to the goal of detection specificity using direct sample analysis with significantly reduced sample preparation but there are still analytical problems and interferences which cannot be resolved by interfacing a collision cell to a mass spectrometer.

By careful control of the conditions in the collision cell, it is possible to transmit the desired ions efficiently. This is possible because in general the desired ions, those that form part of the mass spectrum to be analyzed, are monatomic and carry a single positive charge that is, they have lost an electron. If such an ion collides with a neutral gas atom or molecule, the ion will retain its positive charge unless the first ionization potential of the gas is low enough for an electron to transfer to the ion and neutralize it. Consequently, gases with high ionization potentials are ideal target gases. Conversely, it is possible to remove artefact ions whilst continuing to transmit the desired ions efficiently. For example the artefact ions may be molecular ions such as $ArO^+$ or $Ar_2^+$ which are much less stable than the atomic ions. In a collision with a neutral gas atom or molecule, a molecular ion may dissociate, forming a new ion of lower mass and one or more neutral fragments.

Despite these and other methods and systems that are known in the art and have been developed for removing and/or minimizing isobaric interferences in mass analysis, such interferences can never be completely eliminated in all mass analyses. One particular problem is that of interfering isobaric ions that have a similar chemical reactivity so that the use of conventional CCT-based methods may be limited.

SUMMARY

The present invention provides methods of determining qualitatively and quantitatively whether isobaric interfering species are present during mass analysis in a mass spectrometer.

In a method in accordance with the invention, for determining the presence of isobaric interfering species in mass analysis, there are steps comprising (a) in an ion source, generating first ions that are free of isobaric interfering ions; (b) transmitting the first ions into a reaction cell that contains at least one reaction gas; (c) determining a first reaction profile for the reaction of the first ions with the reaction gas; (d) in the ion source, generating second ions of the same chemical species as the first ions, that may contain isobaric interfering ions; (e) transmitting the second ions into the reaction cell that contains the at least one reaction gas; (f) determining a second reaction profile for the reaction of the second ions with the reaction gas; and (g) comparing the first and second reaction profiles, wherein a difference between the profiles is an indication of isobaric interference being present in the second ions.

The first and second ions can comprise different isotope ions of the same chemical species. For example, the first and second ions can be different isotopes of Ti, such as $^{48}$Ti and $^{49}$Ti. A determination of a reaction profile of a second ion (e.g., $^{49}$Ti) that is different from the reaction profile of first ions from another isotope of the chemical species that is free of isobaric interference (e.g., $^{48}$Ti) is an indication that there is isotopic interference on the second ions.

The first and second ions can also have the same mass. For example, the first and second ions can be ions of the same isotope of the chemical species being measured, wherein the first ions are known to be free of isobaric interference. A measurement of a reaction profile for the second ions that is different from that of the first ions is an indication that there is isobaric interference present in the second ions. The isobaric interfering species is a different chemical species to the first and second ions but which has an isotope that gives rise to an isobaric interference with the second ions. As an example, the first ions could be $^{49}$Ti ions that are free of isobaric interference, and the second ions can also be $^{49}$Ti ions with unknown amount of isobaric interference. A determination of a difference in the reaction profile of the two ions is an indication that there is isobaric interference on the second $^{49}$Ti ions.

The first ions can be first sample ions that are formed from a first sample and the second ions can be second sample ions that are formed from a second sample. The first and second samples are different samples, e.g. having different origins. The first sample can be a reference or standard sample having a known chemical composition (e.g. wherein the first ions are known to be free of any isobaric interference). The second sample can be a sample having at least a partly unknown chemical composition (e.g. wherein the second ions are not known to be free of any isobaric interference).

The determination of a reaction profile can be done by mass analyzing the first and the second ions. Thus, the determination can comprise transmitting the first and/or second ions into a mass analyzer downstream of the reaction cell and determining a signal intensity of the first and/or second ions. The first and/or second ions can be mass analyzed in separate steps (e.g. in sequential mass analysis runs). For the example mass analysis of the first ions can be followed by mass analysis of the second ions.

The invention also provides a method of determining the presence of isobaric interference during mass analysis in a mass spectrometer, the method comprising steps of (i) in an ion source, generating ions of a chemical species having a plurality of isotopes; (ii) transmitting the ions into a reaction cell that contains at least one reaction gas that is capable of forming a molecular adduct with the chemical species; (iii) transmitting the ions from the reaction cell into a mass analyzer and mass analyzing the ions to determine ratios of signal intensities of isotopes of the chemical species to a single interference-free reference isotope, to obtain a set of isotope ratio reaction profiles; and (iv) comparing the isotope ratio reaction profiles in the set, wherein a determination of an isotope ratio reaction profile that is different from the other reaction profiles is an indication of isobaric interference being present for the isotope used to determine the reaction profile that is different.

A reaction profile, in the present context, is the profile of a chemical reaction across a range of experimental conditions. The profile can be determined for example by monitoring the amount (appearance and/or disappearance) of a certain species, e.g. an atomic or molecular ion, across the experimental conditions. The reaction profile can comprise determining the chemical reaction across a single variable. The reaction profile can also comprise determining the chemical reaction across two or more variables, than can be simultaneously altered.

The variable can for example be the pressure (or flow rate) of a reaction gas into a reaction cells, for example a collision cell. The reaction profile can for example comprise monitoring the amount of a certain atomic or molecular ion species as a function of gas pressure in the reaction cell. Alternatively, the reaction profile can comprise monitoring the formation of molecular adducts of the atomic or molecular ion as a function of gas pressure in the cell. Determination of a reaction profile can thus comprise transmitting first and/or second molecular adduct ions that are generated by the reaction of the first and/or second ions with the reaction gas into a mass analyzer downstream of the reaction cell and determining a signal intensity of such first and/or second molecular adduct ions.

Reaction gas can be introduced into the reaction cell at a first flow rate to reach a first pressure, and subsequently the flow rate of the reaction gas can be adjusted to at least a second flow rate to reach at least a second pressure that is different from the first pressure. A reaction profile of ions in the cell (e.g., the first and/or second ions), or molecular adduct ions of the ions, can be determined from a signal intensity of the ions for each such pressure of the reaction gas in the reaction cell. Thus, subsequently to the second flow rate the flow rate of the reaction gas can be adjusted to a plurality of further flow rates to reach a plurality of further pressures. At least three or four, or more different gas pressures are employed to generate the reaction profile of each type of ion (first and/or second ions, or adduct ions thereof).

As an example, the ions introduced into the cell can be $V^+$ isotopes, and the reaction gas can be $O_2$. The signal intensity of one or more such isotope ion can thus be monitored as a function of $O_2$ pressure in the cell. Alternatively, or additionally, the signal intensity of $VO^+$ species formed from the reaction of $O_2$ with $V^+$ in the cell can be monitored. A reaction profile can thereby be determined by either following the disappearance of $V^+$ as a function of $O_2$ pressure, or the profile can be determined by following the formation of $VO^+$.

The reaction profiles (e.g., first and/or second reaction profiles) can be determined by mass analyzing the ions in the mass analyzer to obtain a signal intensity of the ions for each pressure of the reaction gas in the reaction cell.

Alternatively, or additionally, the reaction profiles can be determined by mass analyzing molecular adduct ions that are formed by the reaction of the ions (e.g., first and second ions) with the reaction gas in the mass analyzer to obtain a signal intensity of the molecular adduct ions for each pressure of the reaction gas in the reaction cell.

Two or more ion species that are analyzed by the method can be formed from different samples. For example, when analyzing first ions that are known to be free of isobaric interference, and subsequently second ions that may have isobaric interference, the first and second ions may be formed from different samples, i.e. the first ion from a first sample and the second ions from a second sample. Thus, in the first sample, the first ions are known to be free of isobaric interference. However, in the second sample, which can be a sample of at least partly unknown chemical composition, there may or may not be an isobaric interference of the second ions (i.e. the presence of an isobaric interference is not known).

The gas pressure in the reaction cell during analysis can be suitably adjusted to be in the range of $10^{-5}$ to $10^{-2}$ mbar, more preferably $10^{-4}$ to $10^{-2}$ mbar, more preferably $10^{-3}$ to $10^{-2}$ mbar. The reaction gas flow rate into the reaction cell during analysis can be adjusted to achieve a desired pressure. Thus, the reaction gas flow rate can be adjusted so as to be in the range of about 0.001 to 10 mL/min, preferably in the range of about 0.005 to 5 mL/min.

In certain applications, it can be useful to determine a ratio of signal intensities. Accordingly, the determining of a reaction profile can comprise determining a ratio of signal intensities of at least one isotope of the first and/or second ions. Such determination can for example be useful when using a multicollector for signal detection, since the ratios of signal intensities can be determined to a higher precision than absolute intensities in multicollector detection.

It can be useful to determine signal intensities of the first and second ions to a common reference isotope. The reference isotope can be an isotope of the chemical species being measured, i.e. the chemical species of the first and second ions. For example, the reference isotope can be a $V^+$ isotope, preferably an isotope that is free of isobaric interference, and that can be used when determining signal intensity ratios of other $V^+$ isotopes.

Accordingly, in an embodiment, determination of isobaric interference can comprise comparing a signal intensity ratio of an isotope of the second ions, or molecular adduct ions thereof to a reference isotope, to a signal intensity ratio of the same isotope of the first ions, or molecular adducts thereof, to the same reference isotope.

The determination of a reaction profile can therefore comprise determining the ratio of signal intensities of two or more isotopes of the chemical species being measured (e.g., V isotopes), or molecular adducts thereof, to the same single isotope of the chemical species (e.g. a single V reference isotope), or a molecular adduct thereof.

When comparing signal intensity ratios of the first and second ions, a determination of a signal intensity ratio for isotopes of the second ions that is different from the corresponding signal intensity ratio of the first ions is an indication of isobaric interference being present on the second ions.

The method of determining the presence of isobaric interference based on isotope ratios can comprise steps of (a) in an ion source, generating first ions that are free of isobaric ions and that comprise a chemical species having a plurality of isotopes; (b) transmitting the first ions into a reaction cell that contains at least one reaction gas that is capable of forming molecular adduct ions with the chemical species; (c) mass analyzing the first ions, or molecular adduct ions thereof, to determine ratios of signal intensities of at least one isotope of the chemical species to a single interference-free reference isotope, to obtain a first set of isotope ratio profiles; (d) in the ion source, generating second ions that comprise the same chemical species and that may also comprise at least one isobaric interfering species; (e) transmitting the second ions into a reaction cell that contains at least one reaction gas that is capable of forming a molecular adduct ion with the chemical species; (f) mass analyzing the second ions, or molecular adduct ions thereof, to determine ratios of signal intensities of each of one or more isotopes of the chemical species to the same interference-free reference isotope, to obtain a second set of isotope ratio profiles; and (g) comparing the first and second sets of isotope ratio profiles, wherein a determination of an isotope ratio profile in the second set that is different from an isotope ratio profile in the first set is an indication of isobaric interference being present in the second ions.

In some embodiments, ratios of signal intensities representing the first ions are determined for a plurality of isotopes of the chemical species to the same reference isotope. It can also be useful to determine the ratios for each of the isotopes of the chemical species to the same reference isotope.

The reaction gas can be introduced into the reaction cell at a first flow rate to reach a first pressure, and subsequently the flow rate of the reaction gas can be adjusted to at least a second flow rate to reach at least a second pressure that is different from the first pressure. The isotope ratio profile of the first and/or second ions, or molecular adduct ions thereof, can be determined from a signal intensity of the ions for each such pressure of the reaction gas in the reaction cell. Subsequently to the second flow rate the flow rate of the reaction gas can be adjusted to a plurality of further flow rates to reach a plurality of further pressures.

The isobaric interference can be further determined by (a) determining an interference-free isotope ratio profile of at least one potentially interfering species to the interference-free reference isotope (e.g. a ratio such as $^{52}Cr/^{47}Ti$ or $^{51}V/^{47}Ti$); (b) determining an interference-free isotope ratio profile of at least one isotope of the chemical species being measured (i.e. the chemical species of the first and second ions) to the same interference-free reference isotope (e.g. $^{49}Ti/^{47}Ti$); (c) in a sample that may comprise isobaric interference, determining an observed isotope ratio profile of the same isotope of the chemical species that may be interfered to the interference-free reference isotope (e.g. $^{50}Ti/^{47}Ti$, wherein $^{50}Ti$ may be interfered by an isotope of V or Cr); and (d) calculating the observed isotope ratio profile as a weighted sum of the interference-free isotope ratio profile of the potentially interfering species and the isotope ratio profile of the interference-free isotope of the chemical species being measured. A determination of the relative contribution of the isotope ratio profile of the interfering species to the observed isotope ratio profile is a measure of the isobaric interference in the sample.

It will be appreciated that the isotope of the chemical species being measured in step (b) can have the same mass as the potentially interfering isotope.

An observed reaction profile can be determined as a sum of two uninterfered profiles. For example, a reaction profile of a chemical species with mass $m_1$ and that may contain isobaric interference can be determined as a sum of reaction profiles of species with mass $m_2$ and $m_3$, where the species with mass $m_2$ is a different isotope of the chemical species being measured and $m_3$ is a different isotope of the potentially interfering species having a different mass. The relative contribution of the reaction profiles of species with mass $m_2$ and $m_3$ to the observed reaction profile will be a measure of the interference on $m_1$.

Accordingly, the method of determining isobaric interference in accordance with the invention can further comprise determining at least a third reaction profile for at least third ions, wherein the third ions are the same chemical species as the isobaric interfering ions that may be present with the second ions. Preferably, the third ions are free of any other isobaric interfering ions, or molecular adduct ions thereof. The reaction profile can comprise a signal intensity of the first and/or second ions and/or third ions, or molecular adduct ions thereof, that is determined for two or more pressures in the reaction cell.

The amount of isobaric interfering ions present with the second ions can therefore be determined based on the comparison of reaction profile of the second ions, or molecular adduct ions thereof, to the reaction profile of the first ions, or molecular adduct ions thereof, and the reaction profile of the third ions, or molecular adduct ions thereof.

A quantitative determination of the isobaric interference can comprise determining the reaction profile of the second ions as an algebraic sum of the reaction profile of the first ions and the third ions, or molecular adduct ions thereof, wherein the relative contribution of the reaction profile of the third ions, or molecular adduction ions thereof, and the reaction profile of the first ions, or the molecular adduct ions thereof, represent a quantitative measure of the amount of isobaric interference present with the second ions.

An observed isotope ratio profile can also be determined as a sum of isotope ratio profiles that are known to be free of isobaric interference. The reference isotope used in such analysis is preferably also free of isobaric interference.

The first and second ions can thus comprise different isotope ions of the same chemical species, and the third ions comprise different isotope ions of the same chemical species that is interfering on the second ions and that have a mass that is different from the first ions. The third ions may have a mass that is different from the mass of both the first and the second ions. A corrected isotope ratio of isotopes of the interfered chemical species having mass equal to that of the first and second ions, respectively, can be obtained from the relative contribution of the first (uninterfered) reaction profile to the second reaction profile.

A corrected isotope ratio of isotopes of the interfering chemical species having mass equal to that of the second and third ions, respectively, can be obtained from the relative contribution of the third (uninterfered) reaction profile to the second reaction profile.

The determination can comprise selecting a reference isotope that is free of isobaric interference, and determining an isotope ratio of the first, second and third ions, or molecular adduct ions thereof, to the reference isotope ions, or molecular adduction ions thereof.

The quantifying can therefore be based on the isotope ratio of the first, second and third ions, or molecular adducts thereof, to the reference isotope ions, of molecular adducts thereof.

It can be preferred that the reference isotope be from ions of an isotope of the chemical species being measured. Alternatively, the reference isotope is an isotope of a chemical species different from the chemical species being measured and the potentially interfering species.

In a determination of isobaric interference based on isotope ratios there can be steps of (i) determining an interference-free isotope ratio profile of at least one potentially interfering isotope species to an interference-free isotope that has a different mass; (ii) determining an interference-free isotope ratio profile of at least one isotope of the chemical species being measured to the same interference-free isotope; (iii) in a sample that may comprise isobaric interference, determining an observed isotope ratio profile of the isotope of the chemical species that may be interfered to the same interference-free isotope; and (iv) calculating the observed isotope ratio profile as a weighted sum of the interference-free isotope ratio profile of the interfering isotope species from step (i) and the isotope ratio profile of the interference-free isotope of the chemical species being measured from step (ii), wherein the relative contribution of the isotope ratio profile of the interfering isotope species to the observed isotope ratio profile is a measure of the isobaric interference in the sample.

It is important that the reference isotope be completely interference free, i.e. that the reference isotope be an interference-free isotope. The interference-free isotope can be an isotope of the chemical species being measured that does not have interference. Alternatively, the interference-free isotope is from a different chemical species.

The determination of an isotope ratio profile as a sum of two profiles can be defined by the following equation:

$$({}^{n}\mathrm{I}/{}^{m}\mathrm{R}_{u})_{obs}=a*({}^{n1}\mathrm{I}_1/{}^{m}\mathrm{R}_{u})+b*({}^{n2}\mathrm{I}_2/{}^{m}\mathrm{R}_{u}),$$

where Ru is an interference-free reference isotope, ${}^{n}\mathrm{I}$ is the isotope being measured, and ${}^{n1}\mathrm{I}_1$ and ${}^{n2}\mathrm{I}_2$ are the isotopes of the potentially interfering species and the chemical species that is being measured. The isotopes ${}^{n1}\mathrm{I}_1$ and ${}^{n2}\mathrm{I}_2$ can have a different mass from ${}^{n}\mathrm{I}$, i.e. n, n1 and n2 in the above equation can be different masses. By describing the measured isotope ratio profiles by the equation above and determining the coefficients a and b to fit an observed isotope ratio profile $({}^{n}\mathrm{I}/{}^{m}\mathrm{R}_{u})_{obs}$, the isotope ratios ${}^{n1}\mathrm{I}_1/{}^{n}\mathrm{I}$ and ${}^{n2}\mathrm{I}_2/{}^{n}\mathrm{I}$ can be determined as 1/a and 1/b, respectively.

In the methods of the invention, data on the first, second and/or third ions, or molecular adducts of these ions can be collected for a number of different gas pressures in the reaction cell (such as a collision cell). For each pressure of the reaction gas in the reaction cell, for a first time period, the signal intensity of unreacted first, second or third ions can be determined in the mass spectrometer. When molecular adduct formation is monitored, for a subsequent second time period, the signal intensity of molecular adduct ions of the first, second or third ions can be determined, such that for each pressure of the reaction gas, the efficiency of the formation of molecular adduct ions of the first, second or third ions can be determined.

Alternatively, reaction efficiency can be determined by monitoring the conversion of ions in the collision cell to molecular adduct ions, i.e. by monitoring the ratio of the intensity of molecular adduct ions to the combined intensity of the molecular adduct ions (e.g., $VO^+$) and unreacted ions of the same species (e.g. $V^+$).

The reaction gas in the methods described herein can in general be any useful reaction gas for introduction into reaction cells, such as collision cells. The reaction gas can be selected from $H_2$, $N_2$, $O_2$, $NH_3$, $SO_2$, $CS_2$, NO, $N_2O$, $SF_6$, Xe, Ne, Kr, $CH_4$, $C_2H_6$, $C_2H_4$, $CH_3F$, $SF_6$, $CH_3OH$, CO and $CO_2$.

The mass spectrometer used with the invention can be a single or dual sector mass spectrometer. The mass spectrometer can be an inductively coupled mass spectrometer (ICP-MS). Accordingly, the ion source can be an inductively coupled plasma (ICP) source.

The chemical species measured in the methods described herein can be chemical ions, and the first ions, second ions and isobaric interfering ions accordingly can be elemental ions. An ICP ion source is a suitable source for generating elemental ions. By way of example, the first ions and second ions can be titanium ions and the isobaric interfering ions can be calcium, chromium and/or vanadium ions.

It will be appreciated that the molecular adduct ions, when present, can be molecular adducts of the first, second and/or third ions with the same chemical species. For example, the molecular adducts of the first, second and/or third ions can all be adducts with $O_2$.

The above features along with additional details of the invention, are described further in the examples below, which are intended to further illustrate the invention but are not intended to limit its scope in any way.

BRIEF DESCRIPTION OF THE DRAWINGS

The skilled person will understand that the drawings, described below, are for illustration purposes only. The drawings are not intended to limit the scope of the present teachings in any way.

DESCRIPTION OF VARIOUS EMBODIMENTS

In the following, exemplary embodiments of the invention will be described, referring to the figures. These examples are provided to provide further understanding of the invention, without limiting its scope.

In the following description, a series of steps are described. The skilled person will appreciate that unless required by the context, the order of steps is not critical for the resulting configuration and its effect. Further, it will be apparent to the skilled person that irrespective of the order of steps, the presence or absence of time delay between steps, can be present between some or all of the described steps.

It should be appreciated that the invention is applicable for isotope analysis of gases in general, by mass spectrometry, optical spectrometry, or other types of spectrometry techniques. In general, therefore, the gas that is being analyzed in the system will be variable. Further, the system and method according to the invention is illustrated in the embodiments that follow with a preferred embodiment of a mass spectrometer, but it should be appreciated that the invention is also applicable to other spectrometers, including optical spectrometers, for determining isotope ratio.

Figure 1:
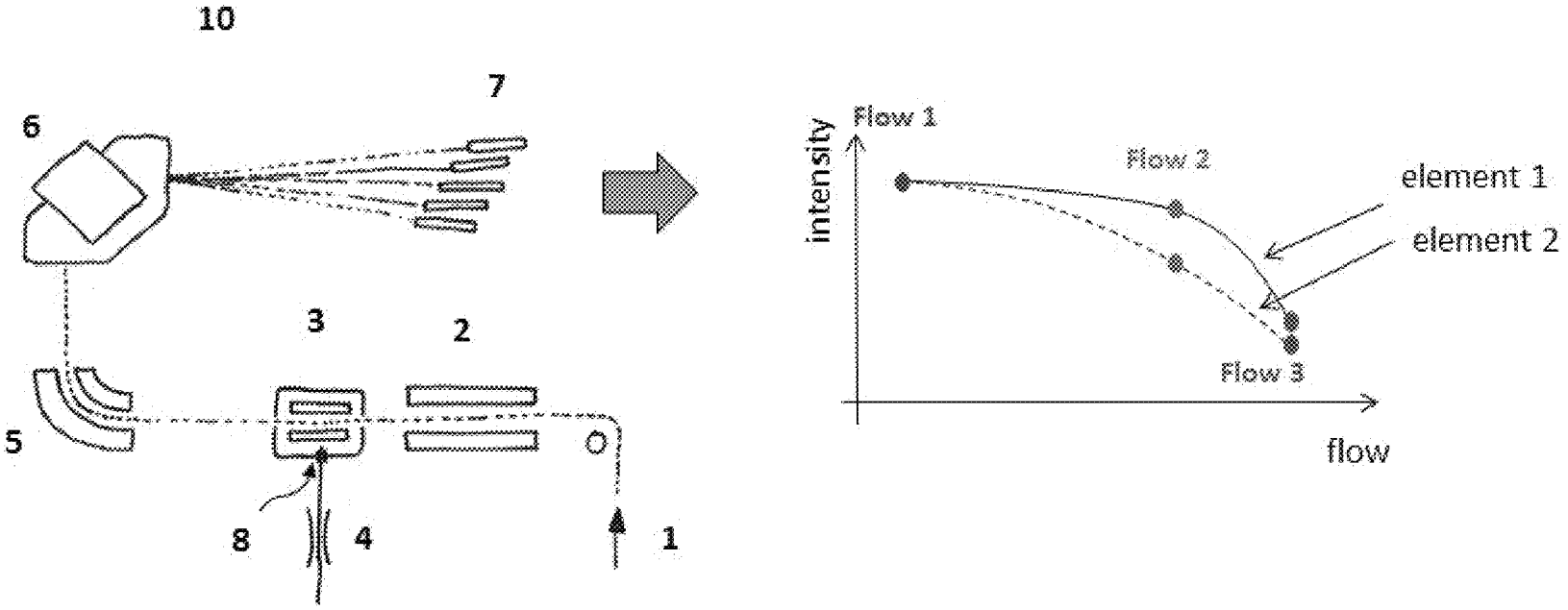
FIG. 1 shows a schematic mass spectrometric analysis of two elemental species for different flow rates of reaction gas that is provided into a collision cell in the mass spectrometer.

In FIG. 1 it is illustrated how a reaction profile can be determined for the reaction of two elements with a reaction gas. On the left, a mass spectrometer 10 is shown, having an ion source 1 that delivers a stream of ions. A preferred ion source is an ICP ion source. The ions are transmitted into a mass filter or focuser 2. The mass filter can for example be a quadrupole and can be configured to only transmit ions in a certain mass range, which can be useful for removing possible contaminants or interfering ions or precursors thereof. Alternatively, the mass filter can be set to transmit ions across a broad mass range.

Elemental ions are transmitted into a collision cell 3 that has a gas inlet 8 for the delivery of a reaction gas into the collision cell. The flow rate of the reaction gas is controlled by a controller, such as a mass flow controller 4. The reaction gas forms molecular adducts with some of the elemental ions in the collision cell. The gas can be chosen so as to be relatively weak in its reaction with the ions to be mass analyzed, i.e. the gas forms adducts at a relatively low rate. Suitable reaction gases can be selected from the group consisting of $H_2$, $N_2$, $O_2$, $NH_3$, $SO_2$, $CS_2$, NO, $N_2O$, $SF_6$, Xe, Ne, Kr, $CH_4$, $C_2H_6$, $C_2H_4$, $CH_3F$, $SF_6$, $CH_3OH$, CO and $CO_2$. Thereby, elemental ions that do not form molecular adducts during the time frame of data collection can be transmitted to the mass analyzer, that can for example be a dual sector mass analyzer that has an electric sector 5, a magnetic sector 6, and a multicollector detector 7.

By monitoring the signal at the detector for the elemental ions as a function of gas flow rate into (and thereby pressure within) the collision cell, the reaction profile for the formation of adducts can be monitored through the decreased elemental ion signal. The flow rate into the collision cell can be adjusted by means of a mass flow controller 4. Alternatively, the pressure in the collision cell can be monitored, by means of a pressure sensor in the collision cell, and a controller that adjusts the mass flow controller so as to reach a preset pressure within the collision cell. In such embodiments, the signal at the detector for the elemental ions can be monitored as a function of reaction gas pressure in the collision cell, and thereby the reaction profile for the formation of adducts can be monitored through the decreased elemental ion signal with increasing pressure.

Figure 2:
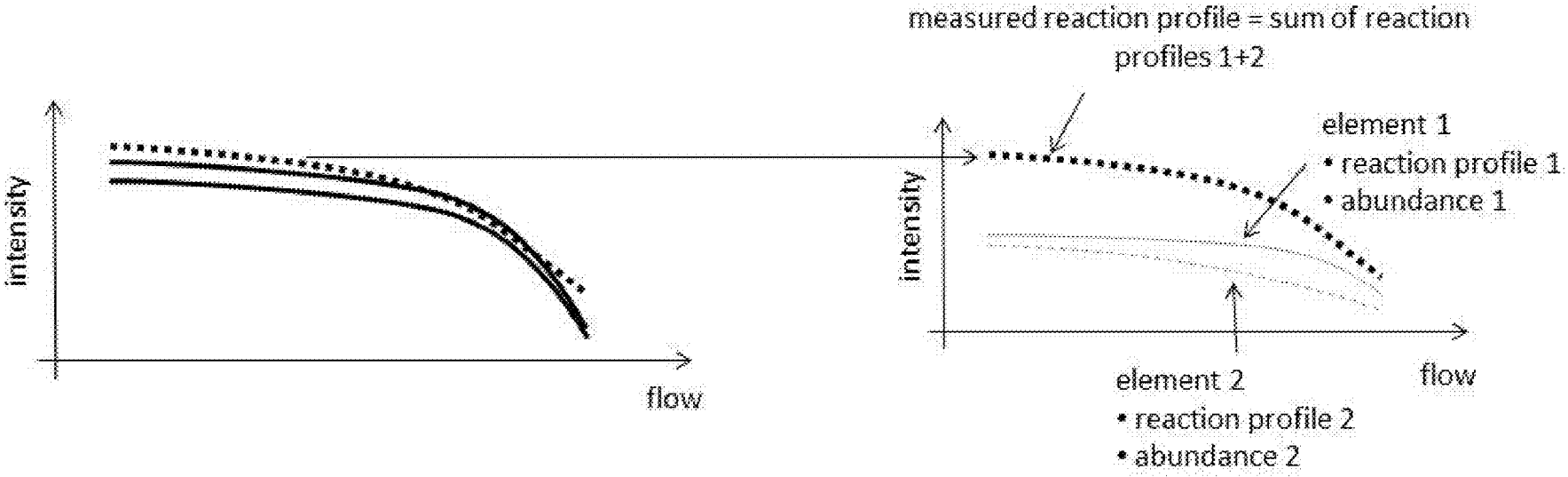
FIG. 2 shows reaction profiles, determined by mass spectrometric analysis, of different isotopes of an elemental species for different flow rates of reaction gas into a collision cell, where two of the isotopes do not contain isobaric interfering species but one does (dotted curve, left graph). Also shown is schematic representation of how an observed reaction profile of an element isotope can be determined as an algebraic sum of the reaction profile of two isotopes having the same mass (right curve).

Different elements can have similar reaction rates with a reaction gas, which can make it difficult when using conventional collision cell methods to determine whether there is isobaric interference on a particular isotope being measured, and/or quantify the amount of the isobaric interference. However, different elements, even those with broadly similar reaction rates, can have different reaction profiles for the formation of a molecular adducts with a reaction gas. This is illustrated in FIG. 2, where the reaction profile for three isotopes of an element (element 1) is shown in the left graph. Two of the isotopes are free of isobaric interfering species, and have identical reaction profiles (solid lines). This can be seen by the reaction profiles having the same shape even if the absolute intensities are different. The third isotope however contains isobaric interference, which manifested by the different apparent reaction profile of the isotope (dotted line). The apparent reaction profile for this isotope is a sum of two reaction profiles—the reaction profile for the reaction of the isotope of element 1 with the reaction gas, and the reaction profile for the reaction of the isobaric interfering isotope of another element (element 2) with the reaction gas. The relative abundance of each of these two isotopes determines the overall observed reaction profile for the measured reaction profile. This is illustrated in the right graph in FIG. 2, where the reaction profile (dashed line) is shown, together with the underlying reaction profiles of element 1 (reaction profile 1) and element 2 (reaction profile 2). The measured reaction profile is an algebraic sum of the two reaction profiles, and can be described by the equation $$I_{obs}(f)=a*I_{e1}(f)+b*I_{e2}(f)$$

wherein I is the observed signal intensity at any given flow rate f, $I_{e1}(f)$ and $I_{e2}(f)$ are the signal intensities at any given flow rate f for the interfering isotopes of element 1 and element 2 respectively, and a and b are the relative fraction of the two elements contributing to the signal, i.e. a+b=1.

It should therefore be apparent that it is possible to estimate the quantity of either species, e1 and e2, and their relative contribution to the observed reaction profile. This can be achieved by determining the reaction profile of either species in a pure form (i.e. in the absence of isobaric interference). Having determined the reaction profiles of the pure species, it is possible to determine the relative contribution of each species to an observed reaction profile, by determining the coefficients a and b in the above equation. If element 1 is pure, i.e. free of interference, the coefficient b will be zero, and the observed reaction profile will be equal to the reaction profile of the separately determined pure e1 adduct species. If however there is isobaric interference present, the observed reaction profile can be determined as a sum of the two pure reaction profiles, wherein the two coefficients a and b that provide the best fit of the observed reaction profile provide an estimate of the amount of each species, e1 and e2. Thereby, the amount of isobaric interference is determined.

Figure 3:
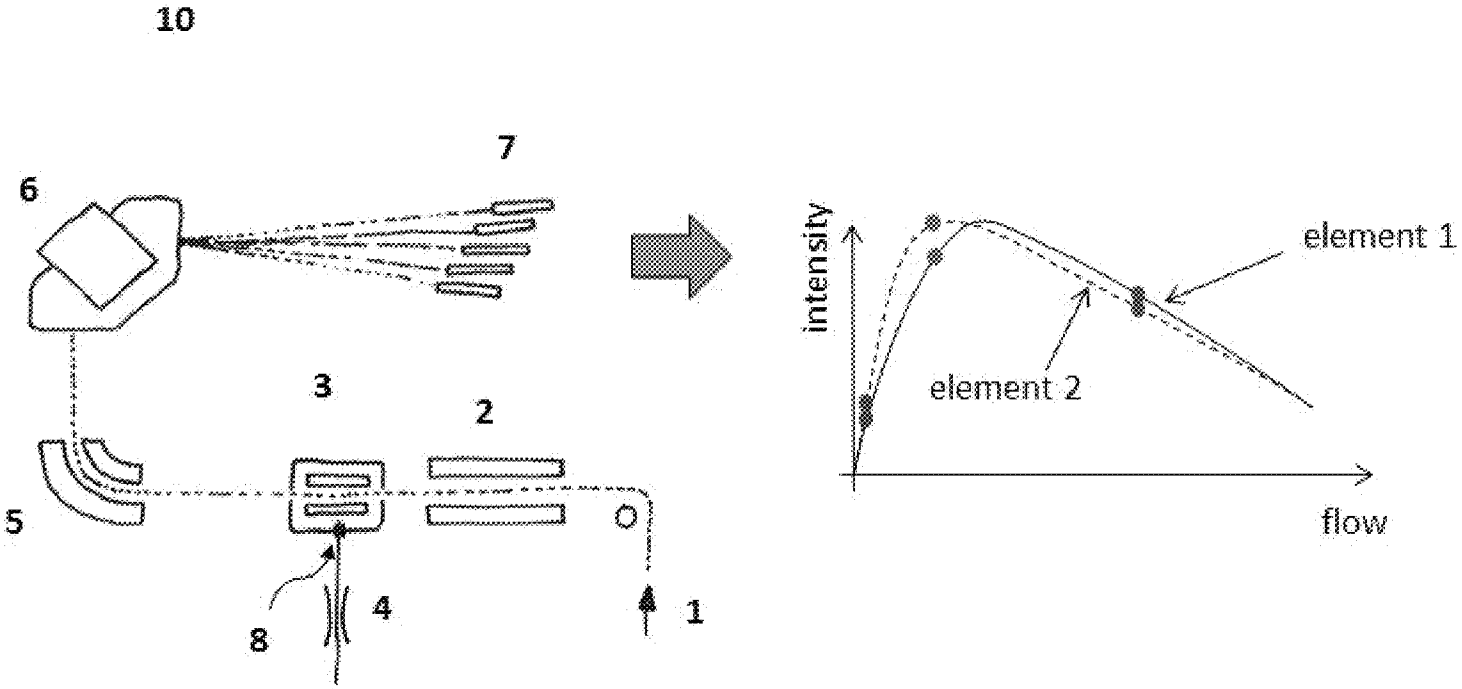
FIG. 3 shows mass spectrometric analysis for the formation of adducts of two elemental species and a reaction gas that is provided into a reaction cell, for different flow rates of the reaction gas into the collision cell.

The reaction profile can also be determined by directly observing the formation of molecular adducts of the reaction gas with the elemental ions. This is illustrated schematically in FIG. 3. On the left there is shown a mass spectrometer 10 with a configuration as described in the foregoing for FIG. 1. The mass analyzer can be set to transmit and detect molecular adducts that are formed by reaction of elemental ions with the reaction gas in the collision cell 3. On the right, a resulting reaction profile is shown for two elements, denoted element 1 and element 2. As can clearly can be seen, the profiles are different, which allows a specific detection of either elemental ion to be performed by monitoring the formation of molecular adducts of either element.

Figure 4:
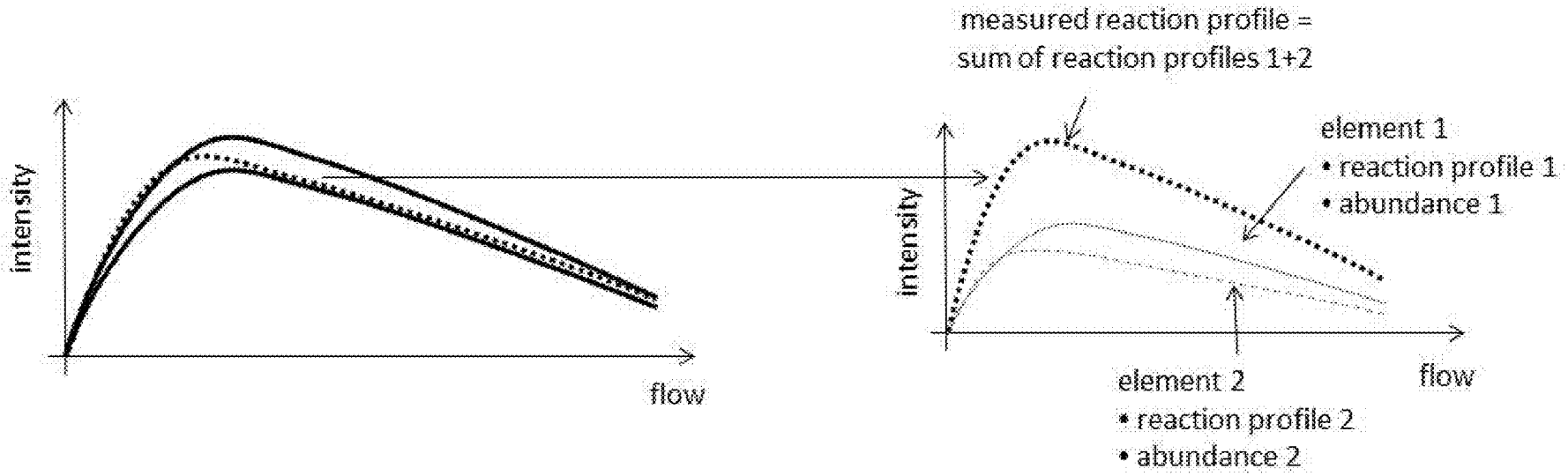
FIG. 4 shows reaction profiles, determined by mass spectrometric analysis, for adduct formation of different isotopes of an elemental species, determined for different flow rates of the reaction gas, where two of the isotopes do not contain isobaric interfering species but one does (dotted curve, left graph). Also shown is schematic representation of how an observed reaction profile of formation of adducts for an element isotope can be determined as an algebraic sum of the reaction profile of adducts of two isotopes having the same mass (right curve).

In FIG. 4, the reaction profiles for three isotopes of an element are shown, two of which are free of interference and therefore are identical (left graph, solid curve), while one reaction profile is representative of a third isotope of the element, which is contaminated by an isobaric interfering adduct (dotted curve). The graph on the right in FIG. 4 shows the measured reaction profile of the molecular adduct as a sum of two profiles, i.e. those of the adduct of element 1 and the adduct of element 2. Determining each of the two profiles in the absence of interference allows the determination of the relative contribution of the two profiles to an observed reaction profile, which will be the weighted sum of two underlying profiles, as described in equation 1 above.

It can also be useful to monitor both the decrease in signal of elemental ions and the increased in signal of molecular adducts as a function of increased reaction gas flow rate into the collision cell. For example, the signal of the elemental species can be monitored for a brief period of time in the mass analyzer (for example, a few seconds). Subsequently, the signal of the molecular adduct ion formed by the reaction of the elemental ion with the reaction gas can be monitored. Thereby, both elemental ion and adduct reaction profiles can be determined.

Figure 5:
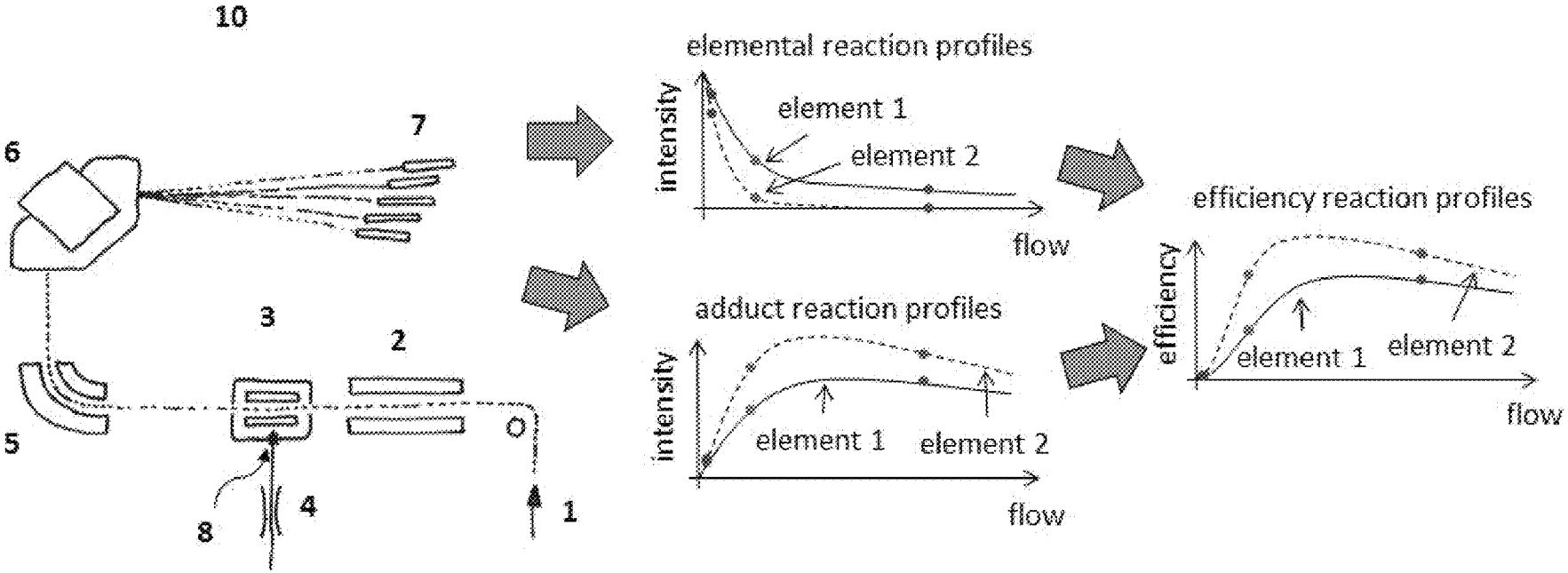
FIG. 5 shows how, by determining reaction profiles based on loss of element ion signals or formation of adduction ions, an efficiency reaction profile for the formation of adducts can be determined.

This is illustrated in FIG. 5, where elemental and adduct reaction profiles are shown to be determined for two elements. Based on the two profiles, a profile of the efficiency of the formation of adducts can be determined (efficiency reaction profile, right graph).

Figure 6:
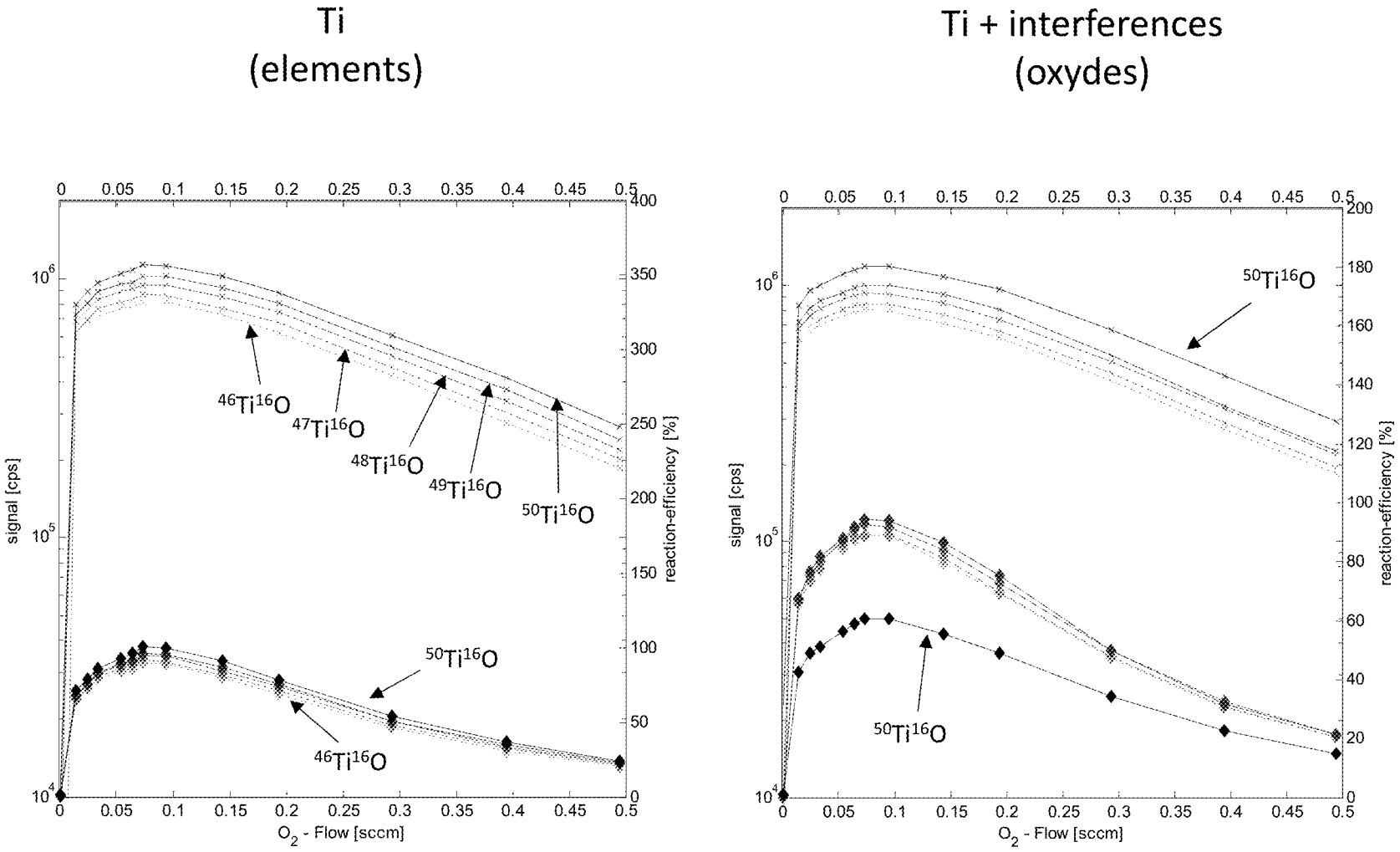
FIG. 6 shows reaction profiles for different isotopes of Ti, showing the loss of element isotope signal (open circles), formation of isotope adducts with oxygen (crosses), and reaction efficiency for the formation of the adducts (filled diamonds). A non-interfered embodiment (FIG. 6A) and an interfered embodiment (FIG. 6B) are shown.

In FIG. 6, reaction profiles are shown for the formation of oxygen adducts of isotopes of Titanium. The curves are normalized to the natural abundances of the Titanium Isotopes. In (A), there are shown reaction profiles of TiO adducts formed through the reaction of of $Ti^+$ with $O_2$ in the collision cell. For each profile, there is an optimal flowrate, at which TiO formation is optimal, as indicated by the peak in the reaction profile and reaction efficiency of the TiO isotopes. Since the thermodynamics of the rate of formation of TiO is identical for the different isotopes, the reaction curves are identical, the only difference being different signal intensities which are due to the instrumental mass bias. As a consequence, the reaction efficiency of TiO formation for the various Ti isotopes is nearly identical (right axis; curves represented by filled diamonds).

In (B), the corresponding reaction profiles in the presence of V interference is shown. The reaction profile for $^{50}Ti^{16}O$ formation is different than for the other isotopes of Ti (increasing divergence of the curves at increased $O_2$ flow rates) due to the presence of $^{50}V$ interference on $^{50}Ti$. The interference is also manifested by the altered profile of the $^{50}Ti$ signal, both in terms of signal intensity and shape of the reaction curve, with increased $O_2$ flow rate, and a very different $^{50}Ti^{16}O$ reaction efficiency curve (filled diamonds). The interference from V in the Ti signal would be very difficult to detect or quantify using prior art methodologies due to the broadly similar reactivity of the two species. However, the small differences in reactivity can give rise to the different reaction profiles utilized by the present invention to detect the interference.

Figure 7:
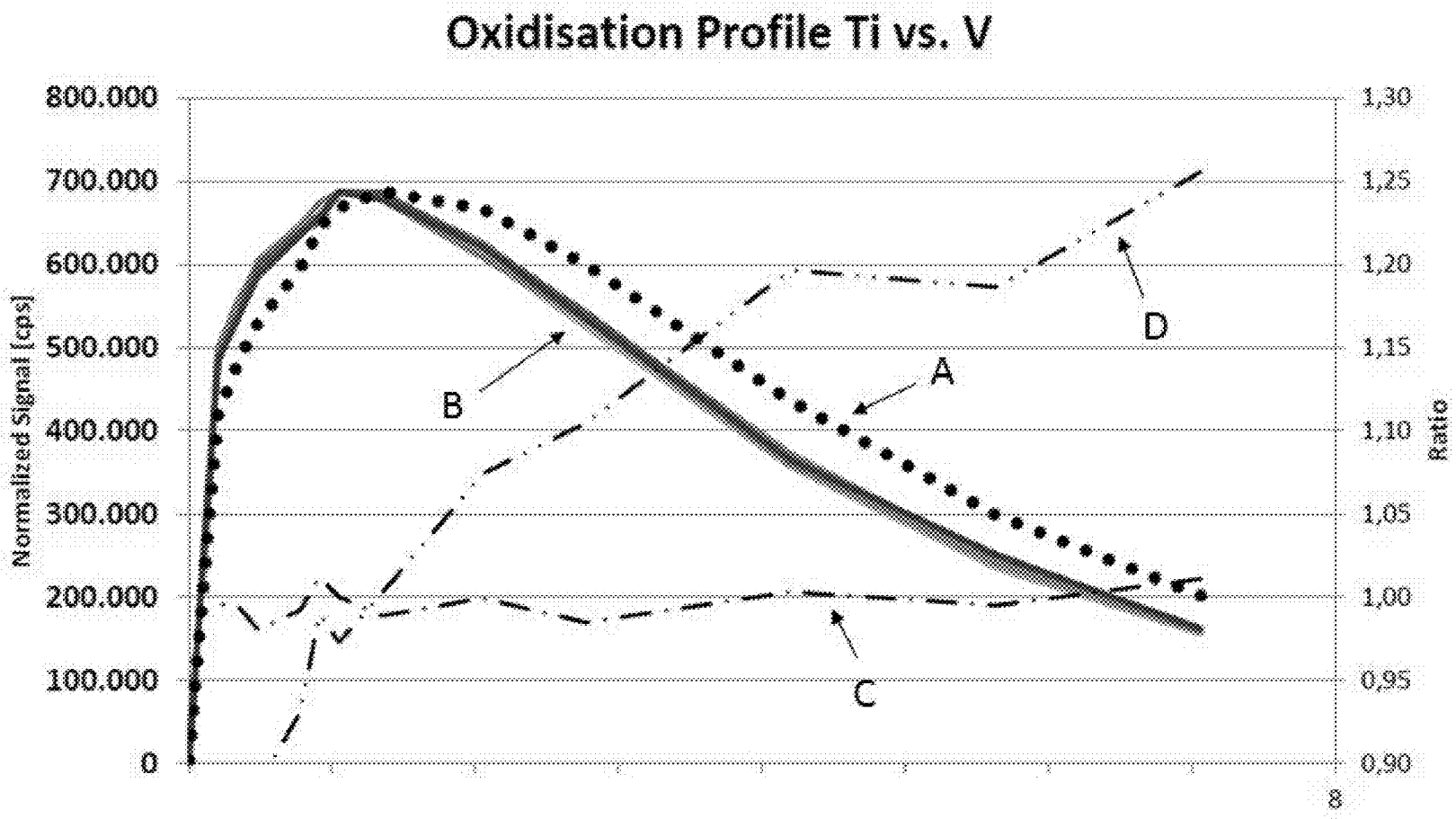
FIG. 7 shows reaction profile for formation of oxygen adducts of Ti isotopes (solid curves), reaction profile for vanadium oxide formation (solid, right shifted curve), and the ratio of $^{66}$TiO to $^{65}$TiO and $^{67}$VO to $^{65}$TiO, respectively (dotted lines).

The data in FIG. 7 shows a reaction profile for the formation of oxygen adducts of Ti isotopes as a function of oxygen gas flow rate into a collision cell. The signal intensity for the different species has been normalized for purpose of comparison. The resulting reaction profiles for the formation of $^{46}Ti^{16}O$, $^{47}Ti^{16}O$, $^{48}Ti^{16}O$, $^{49}Ti^{16}O$ and $^{50}Ti^{16}O$ (curves B) are essentially superimposed, as expected, leading to a $^{50}Ti^{16}O$ to $^{49}Ti^{16}O$ ratio that is close to 1.0 across the entire range of oxygen flow (lower dashed line C). However, despite the fact that the rate of formation of VO is very similar to that for TiO, the reaction profile for VO, exemplified here by the curve for $^{51}V^{16}O$ (Curve A), is shifted to the right compared with the curves for TiO. As a result, the $^{51}V^{16}O$ to $^{49}Ti^{16}O$ ratio changes with reaction gas flow, as indicated by the upper dashed curve (D). This data therefore shows that by determining the reaction profile of adduct formation, in this case oxygen adducts, species that otherwise could not be distinguished in a mass spectrometer can be differentiated by inspection of the reaction profile of their formation of molecular adducts.

Once individual reaction profiles for the relevant isotopes have been determined in the absence of other interfering ions, an observed reaction profile can be simulated as the sum of two profiles for isobaric isotopes. Such calculations can be based either on signal intensities or isotope ratios, the latter being preferable since it provides greater precision.

For ratios, the interference of $^{50}V$ on $^{50}Ti$ could for example be estimated by determining the coefficients a and b in the following equation:

$$(^{50}Ti/^{m}R_u)_{obs}=a*(^{49}Ti/^{m}R_u)+b*(^{51}V/^{m}R_u),$$

where $^{m}R_u$ is any uninterfered isotope (reference isotope) a and b are calibration coefficients of the $^{49}Ti/^{m}R_u$ and $^{51}V/^{m}R_u$ ratios that best describe the observed $^{50}Ti/^{m}R_u$. For reaction profiles obtained at various gas flow rates, these coefficients can be determined by simple curve fitting, for example by least squares analysis.

Example

An application of the present invention is exemplified by the following non-limiting example.

A gaseous sample comprising 180 ppb Ti and 20 ppb Cr was prepared and analyzed. Both elements have an isotope with mass 50, but due to the excess Ti in the sample and the difference in natural abundance, the Ti contribution to mass 50 is about 10 times that of Cr. To resolve the $^{50}Ti$ and $^{50}Cr$ isotopes, a resolving power of about 40,000 would be required. However, as illustrated in the following, using the method of the invention it is possible to determine the contribution of $^{50}Ti$ and $^{50}Cr$ to the observed signal.

The sample was analyzed on a dual sector mass spectrometer with a collision cell upstream of the mass analyzer. A mixture of He and $O_2$ was delivered into the collision cell at various flow rates, and the signal intensities of transmitted Ti and Cr monitored. To assess the effectiveness of the method, the gas flow rate was selected so that neither Ti nor Cr were greatly suppressed.

Figure 8:
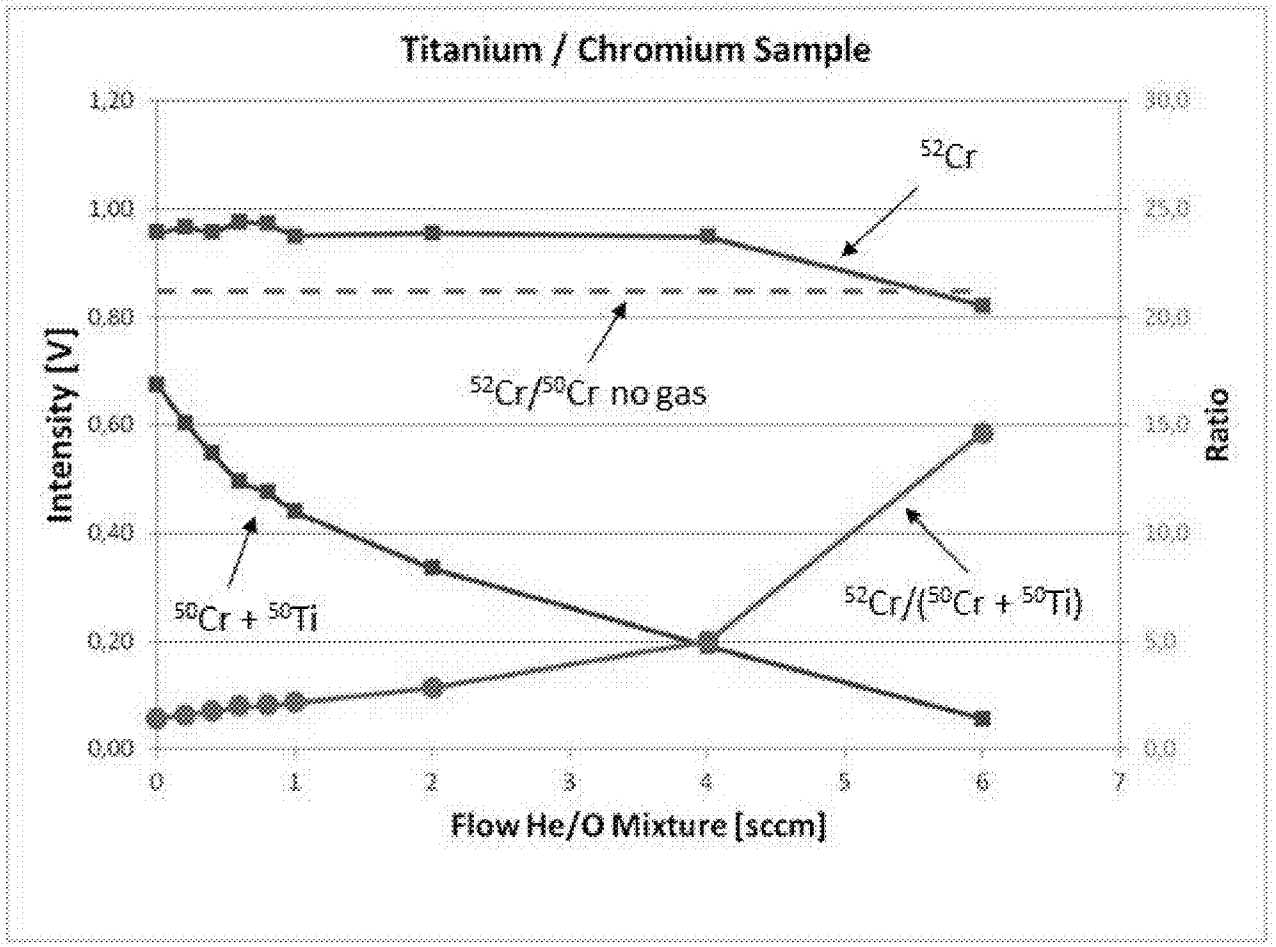
FIG. 8 shows intensities in a mass spectrometric analysis of Ti and Cr isotopes at various flow rates of gas that is introduced into the collision cell (mixture of He and $O_2$). Shown are intensity curves for uninterfered $^{52}$Cr, mass 50 which is a combination of $^{50}$Cr and $^{50}$Ti, as well as the observed ratio of mass 52 and 50. As can be seen, the observed ratio is at no point close to the true ratio (shown by dashed line).

In FIG. 8, results of determination of isotopes with mass 50 and 52 are shown for the gas mixture at various gas flow rates into the collision cell. As the gas flow rate into the cell increases, there is a substantial decrease in the amount of isotope 50, while the intensity for the uninterfered $^{52}Cr$ isotope is almost constant (Ti does not have a stable isotope with mass 52). As a consequence, the observed 52/50 isotope ratio changes markedly with increased flow rate. However, the observed ratio is at no point close to the true $^{52}Cr/^{50}Cr$ ratio (indicated by dashed line).

Figure 9A:
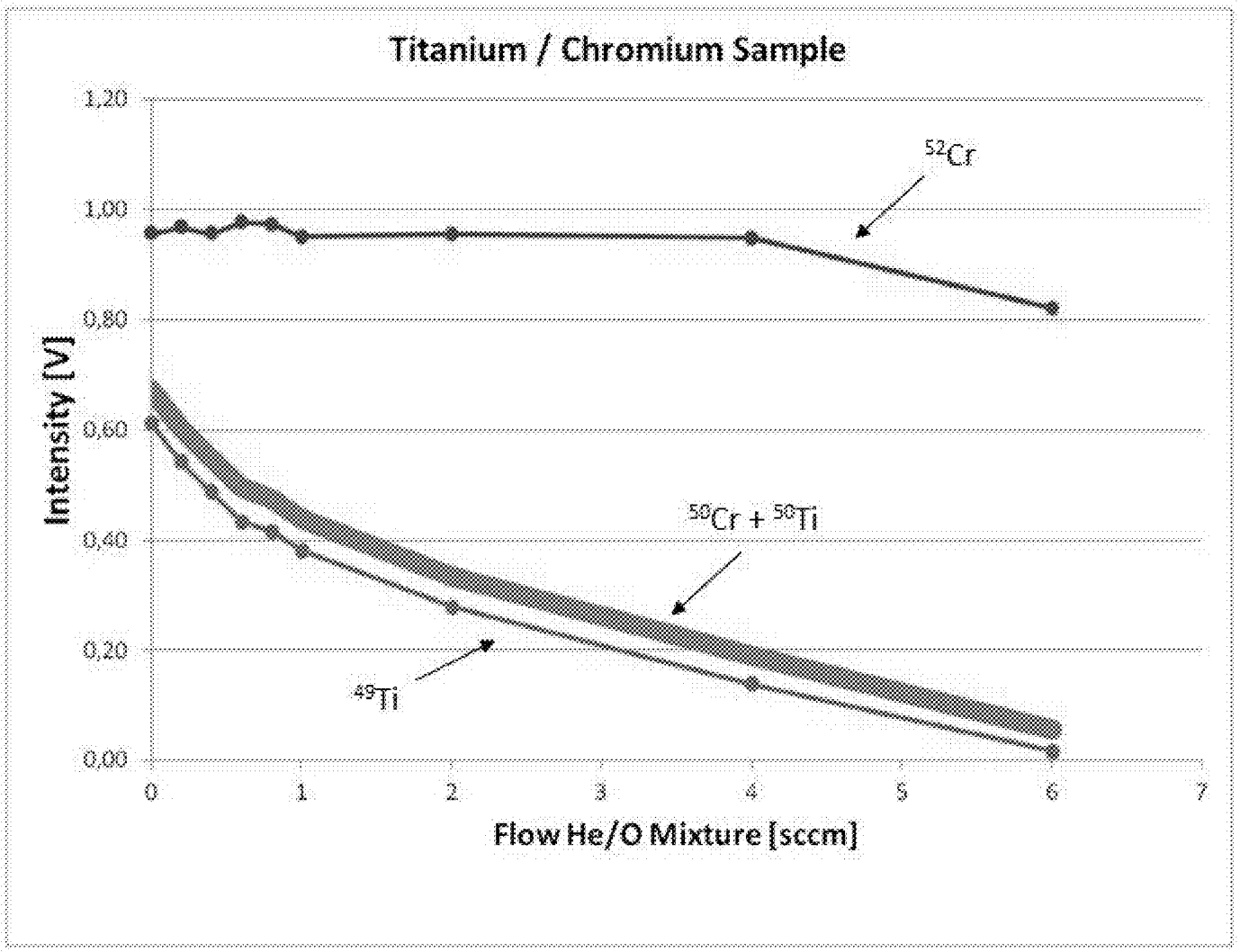
FIGS. 9A, 9B, and 9C show reaction profiles of an interfered signal at mass 50 together with reaction profiles of uninterfered $^{49}$Ti and $^{52}$Cr (FIG. 9A). Also shown is the result of curve fitting of the observed mass 50 reaction curve as a function of the single uninterfered $^{49}$Ti profile (FIG. 9B) and as a sum of the two uninterfered profiles (FIG. 9C).
Figure 9B:
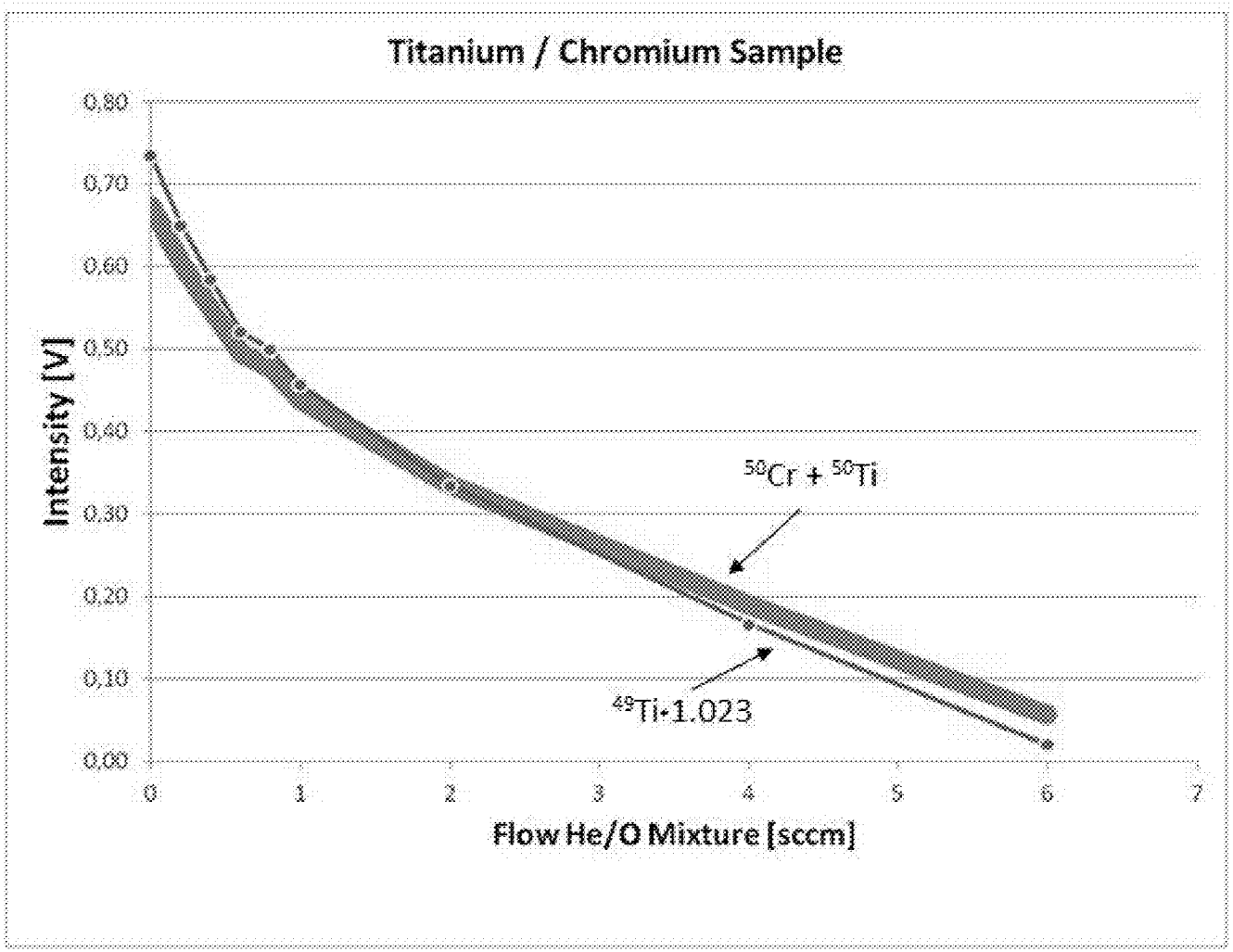
Figure 9C:
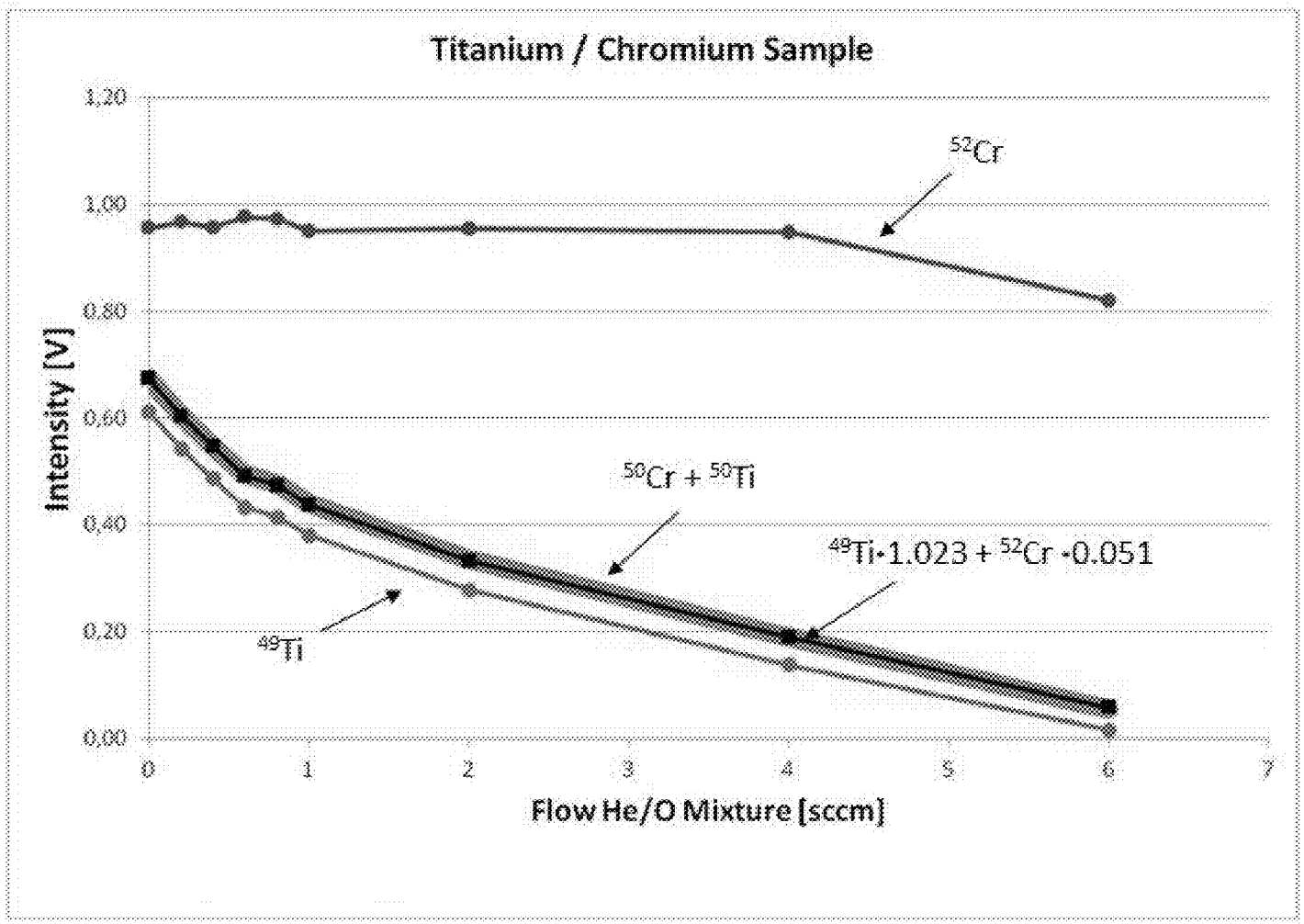

The data in FIG. 9 shows how the method of the invention can estimate the relative contribution of Cr and Ti to the observed abundances. The graph in (A) shows the reaction profile of the interfered species having mass 50 ($^{50}Ti$ and $^{50}Cr$), as well as reaction profiles for uninterfered $^{49}Ti$ and $^{52}Cr$. The reaction profile for $^{49}Ti$ can be used to almost fit that of the profile with mass 50, but the resulting match, shown in (B), is not perfect due to the interference by $^{50}Cr$ on the observed intensity with mass 50. Only by combining the $^{49}Ti$ and $^{52}Cr$ profiles can we provide a good fit for the observed profile with mass 50. The best least-squares fit is obtained as $$I(^{50}(Cr+Ti))_{obs}=0.051*I((^{52}Cr)+1.023*I(^{49}Ti),$$

as also shown by the curve fit in FIG. 9C. Based on these results, the $^{52}Cr/^{50}Cr$ ratio is estimated to be 1/0.051, and the $^{49}Ti/^{50}Ti$ ratio is estimated as 1/1.023.

Figure 10:
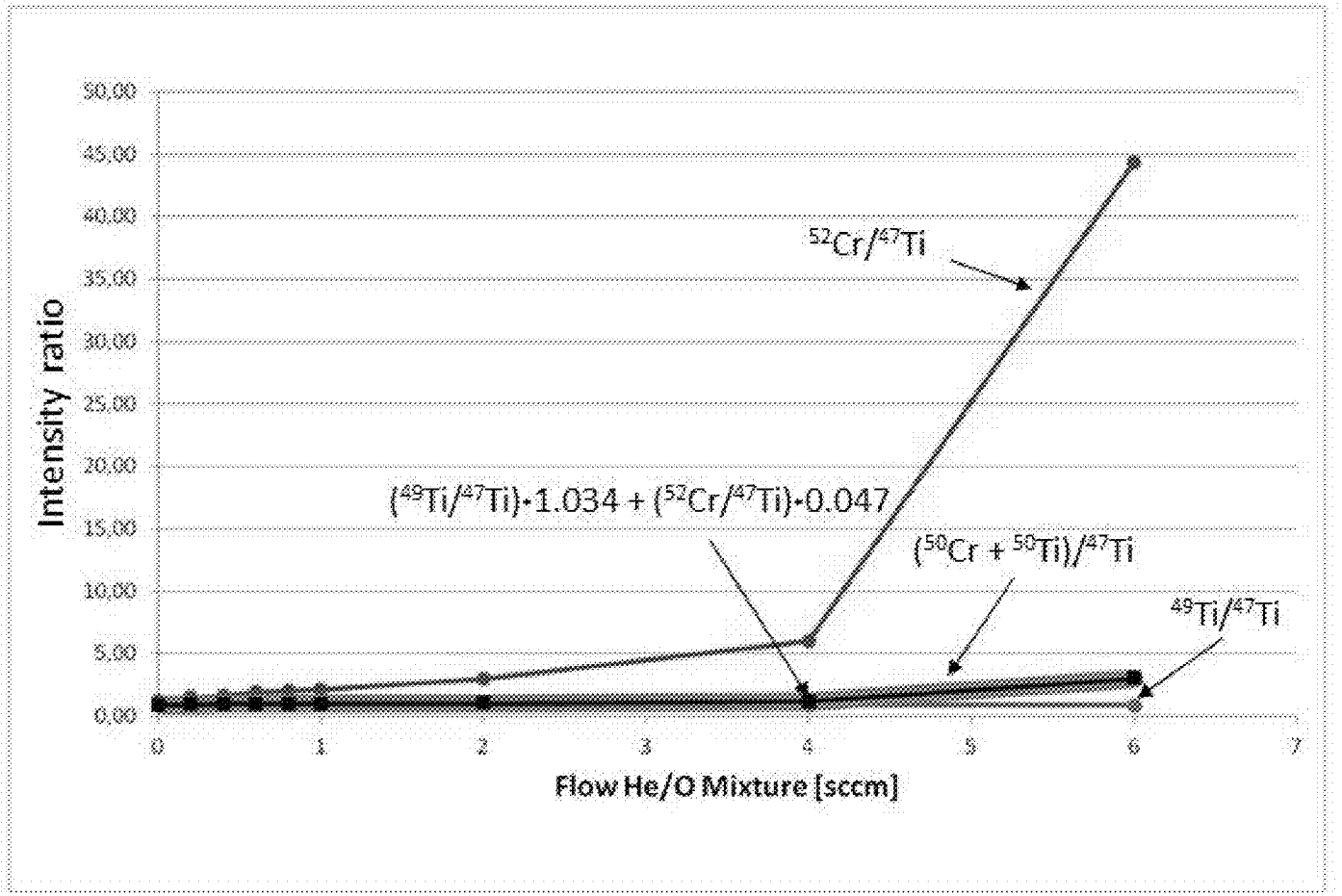
FIG. 10 shows isotope ratio profiles of uninterfered $^{49}$Ti and $^{52}$Cr to $^{47}$Ti as well as the observed isotope ratio profile for mass 50 with respect to $^{47}$Ti. Also shown is how the observed ratio can be determined as the sum of the two uninterfered isotope ratio profiles.

The previous example is based on analysis of absolute intensities. The method can however also be applied to isotope ratios, which gives more accurate results when applied to data obtained using a multicollector instrument. An illustration of such analysis for the above described sample is shown in FIG. 10. To perform the correction of interfered isotopes, an additional, uninterfered isotope is required. In principle, the isotope can be of any element present in the sample, but for practical purposes it can be suitable to use an isotope of the elements being analyzed.

In the present example, the third isotope is $^{47}Ti$. The data in FIG. 10 show the observed $^{50}Ti/^{47}Ti$ profile (which contains $^{50}Cr$ interference) can be calculated as a sum of the observed $^{49}Ti/^{47}Ti$ and the $^{52}Cr/^{47}Ti$ profiles. Least squares curve fitting results in the following:

$$(^{50}Ti/^{47}Ti)_{obs}=1.034*(^{49}Ti/^{47}Ti)+0.047*(^{52}Cr/^{47}Ti)$$

This second analysis gives therefore an estimated value of 1/0.047=21.1752 for $^{52}Cr/^{50}Cr$. This value can be compared with a value of 21.1877 that is obtained for a pure Cr sample that is measured in the absence of gas in the collision cell. By contrast, the observed isotope ratio varies between 2 and 15 depending on the flow rate in the collision cell. Given the natural abundance of $^{52}Cr$ of 83.789%, the method also gives a value for the abundance of $^{50}Cr$ of 3.959%, which can be compared with the true value of 3.961% determined for a pure Cr sample in the absence of reaction gas.

The analysis when applied to Ti isotopes gives an estimate for $^{49}Ti/^{50}Ti$ of 1/1.034=0.967, which can be a value of 0.973 obtained for a pure Ti sample. Again, this is in stark contrast to the observed isotope ratio that varies between 0.25 and 0.91 depending on the gas flow rate into the collision cell. The estimate of the abundance of $^{50}Ti$ from the method is 5.591% (based on the natural abundance of 5.41% for $^{49}Ti$), which can be compared with the true value of 5.563%.

These results show that the method gives highly accurate estimates for isotope ratios.

Figure 11:
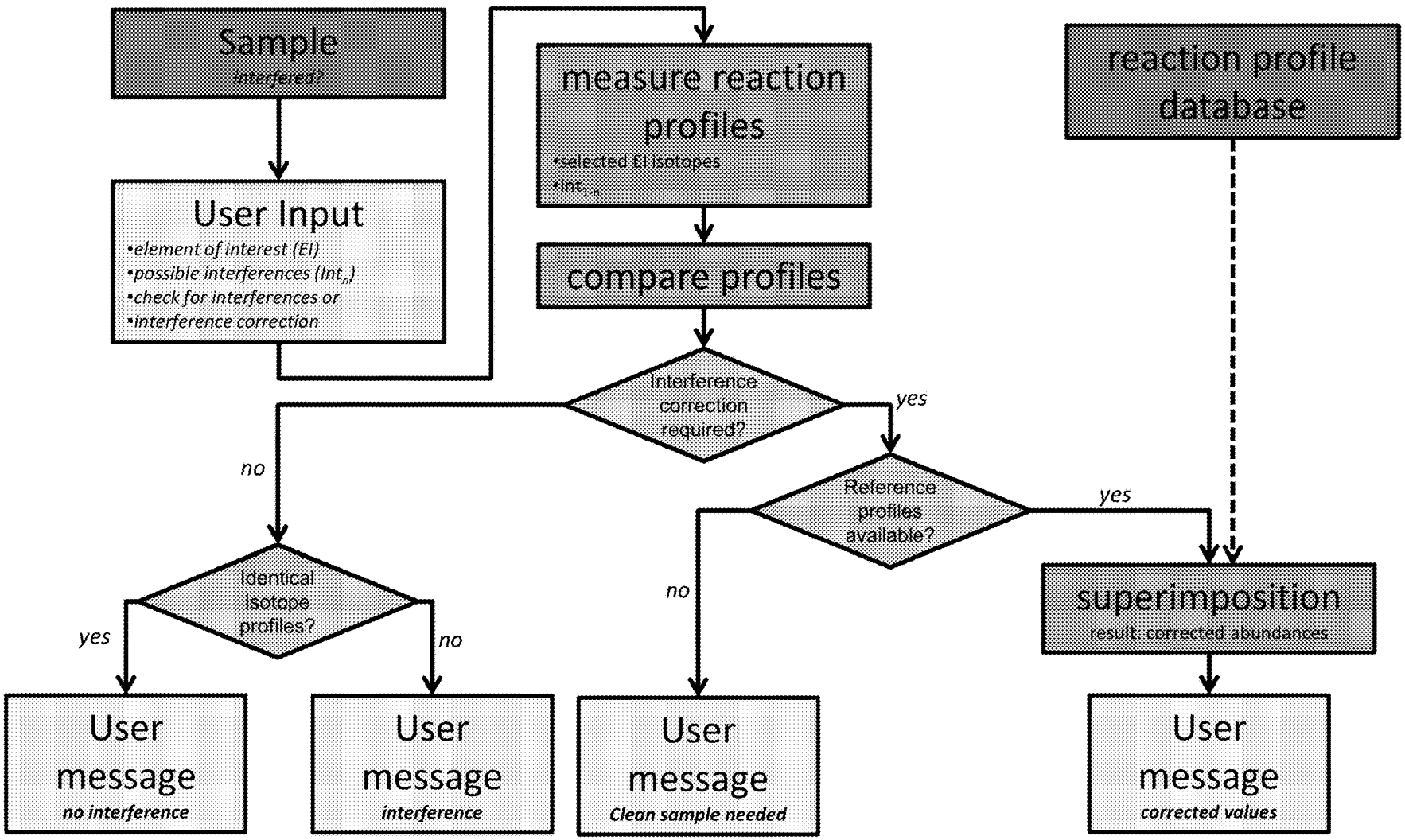
FIG. 11 shows a workflow by which the invention can be realized, based on the nature of the sample being analyzed, availability of reference reaction profiles and the requested output (presence/absence of interference or correction of abundances).

Turning to FIG. 11, there is shown a workflow that shows a practical example of how determination and/or correction of isobaric interference can be realized. The workflow can in part or its entirety be automated on a system that receives experimental and user input and generates an output that can include information about the presence/absence of interference, corrected abundance and/or isotope ratio values or the system can indicate that further information is needed, such as information about clean samples.

Given a sample to be analyzed, initial user input includes providing information about the species of interest, which can for example be a specific element (element of interest, EI). The user is also requested to provide information about possible interferences, for example elemental isotopes that are suspected to interfere with isotopes of the element of interest. The user is furthermore requested to provide information about the required analysis, i.e. whether a determination of the presence/absence of interference is required, or whether a correction of isotope abundance/ratio is also requested.

In the next step, reaction profiles are measured, including selected isotopes of the species of interest (element of interest, EI) in question and any possible interferences that may be present.

Next, a comparison of sample isotope profiles and reference profiles is performed. If only a determination of the presence or absence of interference is requested, there is only need to compare reaction profiles. Thus a comparison of a measured reaction profile to a profile that is known to be devoid of interference can be performed to determine the presence or absence of interference. The comparison can comprise comparing reaction profile of one or more isotope of the element of interest (EI) that may have interference to one or more other isotope of the EI that is known to be interference free. If the profiles are identical, a determination of no interference is made. If the profiles of one or more isotope of the EI is different from the reference profile, a determination of interference being present is made.

Alternatively, the comparison can comprise comparing reaction profile from one or more reference sample that is interference free to the EI reaction profile and determine the presence or absence of interference based on such comparison.

If a correction of abundances and/or isotope ratio is requested, a superimposition of reaction curves is needed, using reference curves that are known to be free of interference. Such reference curves can be obtained from a previously established reaction profile database, if available. Alternatively, the reference curves can be generated for the analysis being undertaken. The relative contribution of reaction curves for an interfering species to an observed reaction curve will be a quantitative measure of the isobaric interference. Abundances and/or isotope ratios that have been determined can then be corrected for the isobaric interference to determine corrected values, i.e. corrected abundances or isotope ratios.

If reference samples are not available for use in the quantitative analysis, the system will inform the user that measurements of clean samples, i.e. samples that do not contain isobaric interference, are needed. Following measurement of such clean samples, a superimposition of measured and reference profiles can be performed to correct measured abundances and/or isotope ratios for the isobaric interference.

It can be seen from the above description that the invention provides improvements in the determination and/or quantification and/or correction of interferences in mass analysis, in particular in elemental mass analysis using an inductively coupled plasma mass spectrometer (ICP-MS).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within the scope of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. A method of determining the presence of isobaric interference during mass analysis in a mass spectrometer, the method comprising:

a. In an ion source, generating ions of a chemical species having a plurality of isotopes;

b. transmitting the ions into a reaction cell that contains at least one reaction gas that is capable of forming a molecular adduct with the chemical species;

c. transmitting the ions from the reaction cell into a mass analyzer and mass analyzing the ions to determine ratios of signal intensities of isotopes of the chemical species to a single interference-free reference isotope, to obtain a set of isotope ratio reaction profiles;

d. Comparing the isotope ratio reaction profiles in the set, wherein a determination of an isotope ratio reaction profile that is different from the other reaction profiles is an indication of isobaric interference being present for the isotope used to determine the reaction profile that is different.

2. The method of claim 1, wherein the interference-free reference isotope is an isotope of the chemical species being measured.

3. A method of determining the presence of isobaric interference during mass analysis in a mass spectrometer, the method comprising:

a. in an ion source, generating first ions that are free of isobaric ions and that comprise a chemical species having a plurality of isotopes;

b. transmitting the first ions into a reaction cell that contains at least one reaction gas that is capable of forming molecular adduct ions with the chemical species;

c. mass analyzing the first ions, or molecular adduct ions thereof, to determine ratios of signal intensities of at least one isotope of the chemical species to a single interference-free reference isotope, to obtain a first set of isotope ratio profiles;

d. in the ion source, generating second ions that comprise the same chemical species and that may also comprise at least one isobaric interfering species;

e. transmitting the second ions into a reaction cell that contains at least one reaction gas that is capable of forming a molecular adduct ion with the chemical species;

f. mass analyzing the second ions, or molecular adduct ions thereof, to determine ratios of signal intensities of each of one or more isotopes of the chemical species to the same interference-free reference isotope, to obtain a second set of isotope ratio profiles;

g. comparing the first and second sets of isotope ratio profiles, wherein a determination of an isotope ratio profile in the second set that is different from an isotope ratio profile in the first set is an indication of isobaric interference being present in the second ions.

4. The method of claim 3, wherein the reaction gas is introduced into the reaction cell at a first flow rate to reach a first pressure, and wherein subsequently the flow rate of the reaction gas is adjusted to at least a second flow rate to reach at least a second pressure that is different from the first pressure, and wherein the reaction profile of the first and/or second ions, or molecular adduct ions thereof, is determined from a signal intensity of the ions for each such pressure of the reaction gas in the reaction cell.

5. The method of claim 4, wherein subsequently to the second flow rate the flow rate of the reaction gas is adjusted to a plurality of further flow rates to reach a plurality of further pressures.

6. The method of claim 3, wherein the interference-free reference isotope is an isotope of the chemical species being measured.

7. The method of claim 3, further comprising determining isobaric interference by:

a. determining an interference-free isotope ratio profile of at least one potentially interfering species to the interference-free reference isotope;

b. determining an interference-free isotope ratio profile of at least one isotope of the chemical species being measured to the same interference-free reference isotope;

c. in a sample that may comprise isobaric interference, determining an observed isotope ratio profile of the same isotope of the chemical species that may be interfered to the interference-free reference isotope; and d. calculating the observed isotope ratio profile as a weighted sum of the interference-free isotope ratio profile of the potentially interfering species and the isotope ratio profile of the interference-free isotope of the chemical species being measured;

wherein a determination of the relative contribution of the isotope ratio profile of the interfering species to the observed isotope ratio profile is a measure of the isobaric interference in the sample.

8. The method of claim 7, wherein the interference-free reference isotope is an isotope of the chemical species being measured.

9. The method of claim 7, wherein the isotope of the chemical species being measured in step b) has the same mass as the potentially interfering isotope.

* * * * *